United States Patent [19]

Mason

[11] 4,398,961

[45] Aug. 16, 1983

[54] METHOD FOR REMOVING PAINT WITH AIR STREAM HEATED BY HOT GAS

[76] Inventor: Richard R. Mason, 611 S. Hansell St., Thomasville, Ga. 31792

[21] Appl. No.: 211,701

[22] Filed: Dec. 1, 1980

[51] Int. Cl.[3] ..... B08B 5/00

[52] U.S. Cl. ..... 134/19; 134/37; 134/38

[58] Field of Search ..... 134/19, 37, 38

[56] References Cited

U.S. PATENT DOCUMENTS

| | | | |
|---|---|---|---|
| 1,074,755 | 10/1913 | Spira | 126/401 |
| 1,437,331 | 11/1922 | Alexander | 134/38 |
| 2,326,630 | 8/1943 | Fagan | 126/401 |
| 2,583,779 | 1/1952 | Jones | 134/2 |
| 2,652,104 | 9/1953 | Prent | 126/401 |
| 2,664,945 | 1/1954 | Maresca | 126/401 |
| 2,684,531 | 7/1954 | Smith | 30/140 |
| 3,079,980 | 3/1963 | Mihm | 126/401 |
| 3,854,997 | 12/1974 | Peck et al. | 134/7 |

*Primary Examiner*—Richard V. Fisher
*Attorney, Agent, or Firm*—Alan Ruderman

[57] ABSTRACT

A method and apparatus for removing old paint from a painted surface by directing a high velocity heated stream of air onto the painted surface. Pressurized air and a liquid petroleum fuel enter the paint remover housing wherein the fuel is ignited and applied to heat the pressurized air which thereafter flows through a nozzle to exhaust from the device. The pressure of the air entering the paint removing device is in the range of 90 to 100 psi and the temperature at which the air exhausts is in the range of 400° to 500° F. Four embodiments of the paint removing device are disclosed including one in which the fuel mixture and pressurized air are mixed to directly transfer the heat from the burning gases to the compressed air. Also disclosed is a bypass valve for low pressure lighting of the device and flame maintenance, and a gas fuel pressure regulator for controlling the gas pressure by the air pressure.

5 Claims, 6 Drawing Figures

METHOD FOR REMOVING PAINT WITH AIR STREAM HEATED BY HOT GAS

BACKGROUND OF THE INVENTION

This invention relates to an apparatus and method for removing paint from surfaces and more particularly to the removal of paint by the application of a high velocity heated air stream directed at the surface.

When refinishing painted surfaces the old layers of paint should be removed. The removal of this paint conventionally has been performed by numerous methods including scraping, scrubbing or blasting with an abrasive, and burning with a flame. The latter is the generally used method of removing paint quickly and effectively from large surfaces and is performed with a heating torch applying a high temperature gas jet onto the painted surface. Because of the high temperature of the flame and the inherent danger of fire various prior art flame spreader constructions have been developed to prevent the concentration of the flame at the surface. However, although these high temperature torches are effective when paint is being removed from metal structures, the burning of paint off wood structures not only may cause damage to the wood but still presents the hazard of a fire. Examples of the known prior art paint removing torches are illustrated in U.S. Pat. Nos. 1,074,755; 2,326,630; 2,583,779; 2,652,104; 2,664,945; 2,684,531; and 3,079,980.

SUMMARY OF THE INVENTION

Consequently, it is a primary object of the present invention to provide paint removing apparatus that rapidly and effectively removes paint from various surfaces including wood surfaces while substantially eliminating the danger of fire.

It is another object of the present invention to provide a method and apparatus for effectively removing paint from a surface utilizing a high velocity heated air stream.

It is a further object of the present invention to provide a method and apparatus for removing paint from a surface comprising the heating of a pressurized air stream in a heat chamber and directing the heated air stream through a nozzle onto the surface.

It is a still further object of the present invention to provide a method and apparatus for removing paint from a surface which comprises heating a high pressure air stream by a gas burner in a heat exchange chamber, mixing the gas and the air and discharging the mixture through a nozzle onto the surface.

It is a yet still further object of the present invention to provide paint removing apparatus that heats a high pressure compressed air stream and exhausts the stream through a nozzle, the air being heated by a gas fueled burner including valving providing for low gas and air pressure lighting conditions and flame maintenance.

It is a still yet further object of the present invention to provide paint removing apparatus comprising a burner for heating a pressured air stream and a nozzle for directing the heated stream onto a work surface, the burner being fueled by a preheated pressurized gas fuel and valve means for maintaining the fuel in a gaseous state at entry to the burner at a slightly higher pressure than the air to prevent flame out.

Accordingly, in carrying out the principles of the present invention there is provided apparatus including a housing into which compressed air is fed, heated by a burner and exhausted through a nozzle. The burner is gas fueled and the combustion products are directed into heat exchange relationship with the high pressure air and exhausted. In one embodiment heat transfer occurs by direct contact mixing of the air and combustion products. In the other embodiments the heat transfer occurs in shell type or a tube type heat exchangers with mixing occuring either prior to the entry of the fluids into the nozzle or by maintaining the two gasses separate until exhausted. In two embodiments the direction of air flow is controlled so that the unheated air first cools the outer skin of the housing and is preheated prior to entry into the main heat exchange chamber.

Another aspect of the invention is the provision of valving for lighting the burner under low pressure conditions and for maintaining the flame while air flow is greatly reduced. The gas valving includes a main air supply valve, a fuel supply valve and an air by-pass valve, the latter two preferably being controlled by a common operator. When the main air valve is closed a small stream of air may be permitted by the by-pass valve to flow around the main valve to the burner.

A further aspect of the invention is a gas pressure regulator valve for adjustably controlling the gas pressure to light the burner and for automatically increasing the gas pressure to the burner as the air flow is increased to a maximum, and which thereafter is adjustable to control the burner temperature.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
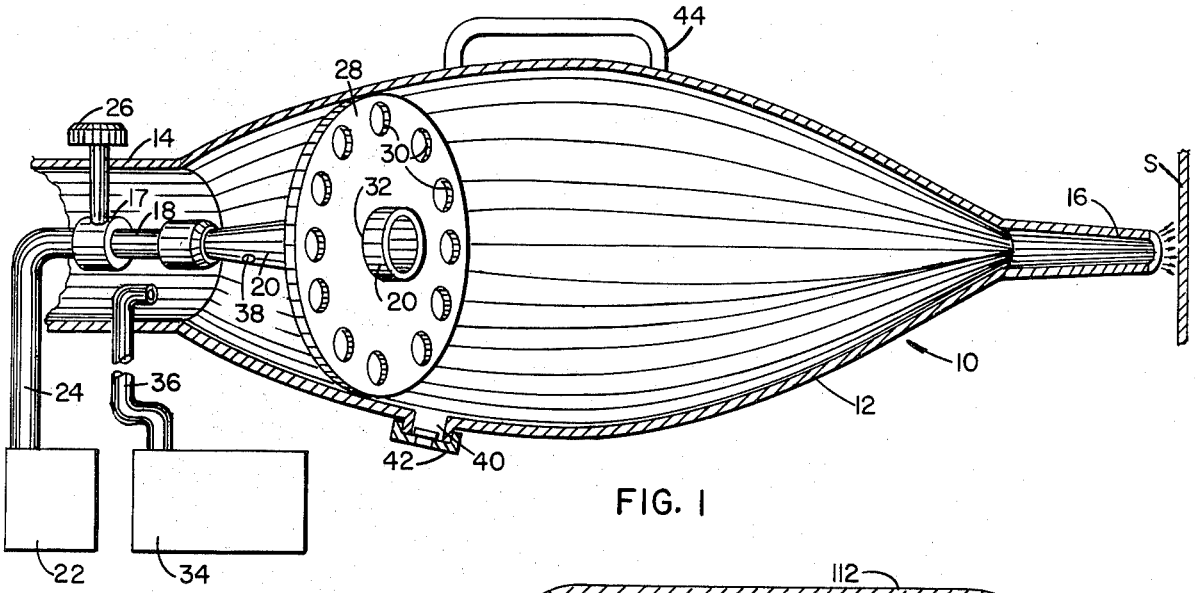
FIG. 1 is a diagrammatic perspective view of a first embodiment of a paint removing device constructed in accordance with the principles of the invention and with parts thereof broken away and with other parts illustrated in block form for clarity of presentation.

Referring now to FIG. 1 a first embodiment of the paint removing device constructed in accordance with the principles of the present invention is illustrated generally at 10 and comprises a substantially hollow housing 12 of any convenient shape and configuration, but preferably as illustrated may be of an oblong configuration for convenience in handling. The oblong housing 12 opens into a cylindrical section 14 at the rear thereof and into a smaller externally substantially cylindrical section 16 at the opposite end at the front thereof. The interior of the hollow cylindrical portion 16 defines a nozzle through which compressed air and combusted fuel exhaust to be directed at the painted surface. Mounted within the larger cylindrical portion 14 is a burner fuel control valve 17 which is connected at its front end to one end of a conduit 18 which supplies a fuel such as propane gas or other readily available L.P. fuel combustible in the presence of air to a mixing section 20 of the burner. The fuel is fed to the valve 17 from a tank 22, the fuel flowing through a line 24 to the valve, the valve being controlled by a knob 26.

Disposed within the housing 12 adjacent the enlarged cylindrical portion 14 is a mixing plate 28. The plate is of substantially the same cross sectional configuration as the housing at the location where it is disposed and of a size such that the periphery of the plate fits snuggly within the housing. The plate has a plurality of holes 30 radially disposed about the surface thereof for communicating the housing at one side of the plate with the housing at the other side thereof. The plate also has a centrally disposed aperture 32 through which the mixing section 20 of the burner is positioned, and the end of the mixing section extending downstream toward the nozzle.

Compressed air from a source such as a tank or a compressor generally illustrated at 34 is supplied through a line 36 to the rear cylindrical portion 14 and flows downstream. The burner includes a small aperture 38 into which primary air for supporting burning flows. The remaining supply of air flows through the holes 30 where it mixes with the heated gases forming the flame of the burner which travels through the mixing chamber 20 toward the nozzle. The compressed air in so mixing is heated in the chamber between the plate 28 and the nozzle 16. The heated high pressure air and gas exit through the nozzle and are directed upon the surfaces from which the paint is to be removed.

The housing 12 may include a port 40 which opens into the interior of the housing adjacent to the downstream surface of the plate 28 and may receive a spark generator or match for lighting the burner as the gases exhaust from the mixing chamber 20. A cap 42 normally covers the port 40 and may comprise a piece of high temperature glass for observing the burner flame. A carrying handle 44 may be provided on the housing 12 for ease of carrying and directing the unit.

In this embodiment and the others which follow excellent results appear when the temperature of the air exiting from the nozzle is in the range of approximately 400° to 500° F. and when the pressure of the air entering the device is in the range of approximately 90 to 100 psi. The exact configuration of the nozzle 16 will generally depend upon the temperature and pressure of the mixture entering the inlet of the nozzle. It is desirable that the velocity of the gases exiting from the nozzle be high and a converging-diverging nozzle rather than a converging nozzle as illustrated may be more appropriate under the pressure and temperature range found ideal.

Figure 2:
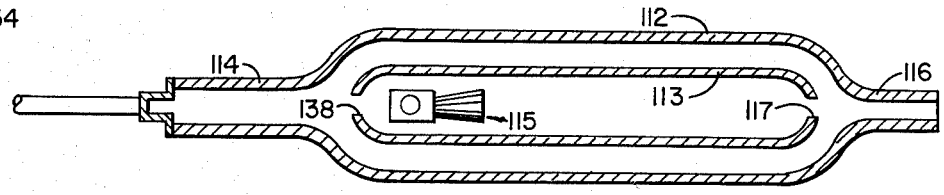
FIG. 2 is a sectional view taken lengthwise through a second embodiment of a paint removing device constructed according to the present invention.

In FIG. 2 a second embodiment of the invention is illustrated in which the compressed air and the flame are maintained separate until mixed slightly prior to entering the nozzle. The paint removing device has a first housing 112 disposed about a second housing 113. The burner illustrated generally at 115 is disposed within the housing 113 while the compressed air enters the rear section 114 and flows between the housings 112 and 113. Some of the air is bled through a bleed hole 138 in the rear of the inner housing as primary air for supporting combustion. Heat is transferred to the air by conduction through the wall of the housing 113 to preheat the air. The gases from the burner are exhausted through a hole 117 in the housing 113 and mix with the now warm compressed air prior to entry into the nozzle 116. The flow of the fuel to the burner and of the compressed air into the device are similar to that of the first embodiment.

Figures 3, 4:
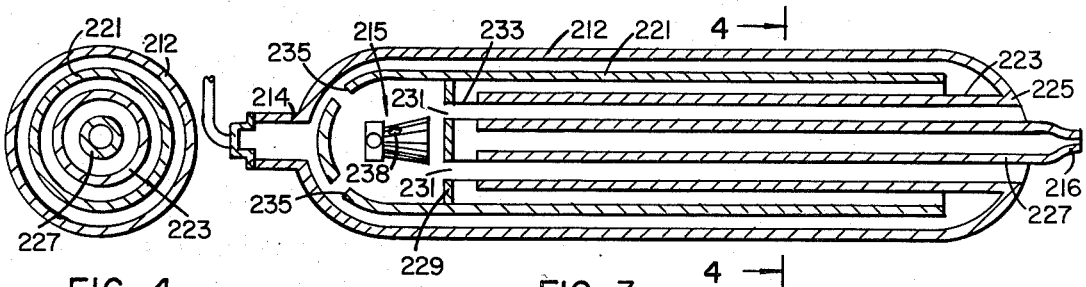
FIG. 3 is a cross sectional view taken lengthwise through a third embodiment of the invention.
FIG. 4 is a cross section taken substantially along line 4—4 of FIG. 3.

In the third embodiment the paint removing device comprises a series of four substantially concentric housings. As illustrated in FIGS. 3 and 4 the outer housing 212 is maintained cool by the compressed air which flows in from the rear portion 214 between the outer housing 212 and the next adjacent housing 221 from which it is spaced. A third housing 223 is disposed within the housing 221 and extends forwardly beyond the housing 221 into sealed relationship with the outer housing 212 at 225. The fourth housing 227 is disposed internally of the third housing 223 and extends outwardly beyond the other housings to form a nozzle 216. The burner 215 is disposed within the rear portion of the second housing 221, and a plate 229 is disposed downstream of the burner within and across the second housing. The plate 229 includes a pair of apertures 231 connected to tubes 233 which open into the space between the housing 223 and the internal housing 227. The second housing 221 also includes one or more apertures 235 for communicating the compressed air from the space between the first and second housings into the second housing for primary combustion air for the burner 215. With this construction compressed air flows forwardly between the housings 212 and 221 and then at the front reverses direction and flows rearwardly between the housings 221 and 223 until it reaches the plate 229, at which time it flows over the tubes 233 and into the hollow of the internal housing 227. The combustion gases flow through the tubes 231 between the housings 225 and 227. Thus, the outer housing 212 is maintained cool while the compressed air is warmed as it flows rearwardly between the second and third housings and is heated in the fourth housing as it flows forwardly to exhaust out the nozzle 216. The combustion products in this embodiment are maintained separate from the heated air until after they are exhausted from the apparatus.

Figure 5:
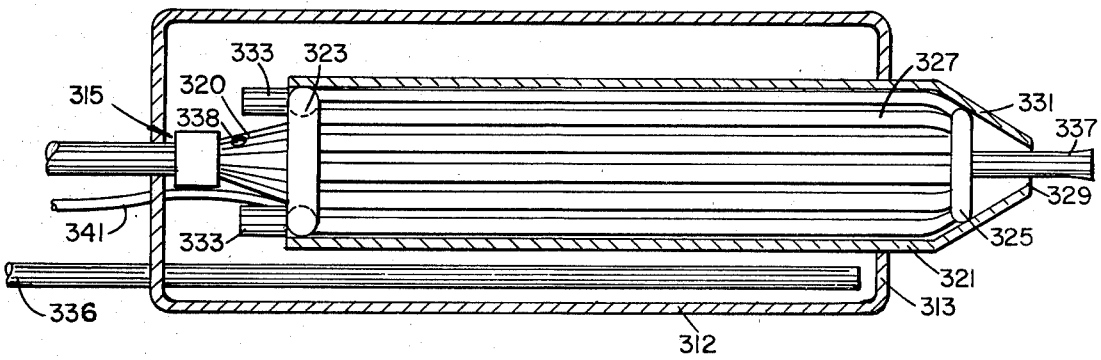
FIG. 5 is a longitudinal cross sectional view through another embodiment of a paint remover constructed in accordance with the principles of the present invention.

In the fourth embodiment, as illustrated in FIG. 5, the compressed air enters through the tube 336 and flows forwardly within the outer housing 312. Disposed within the housing 312 is a second housing 321 which extends forwardly beyond the front of the outer housing. The outer housing is sealed at the forward end 313 against the adjacent portion of the housing 321. Positioned within the housing 321 is a tube type heat exchanger having a rear manifold 323 and a front manifold 325. A plurality of longitudinally extending tubes 327 are connected between and communicate with each of the manifolds 323 and 325 which are annular members, so that the tubes 327 extend about a central open core. The burner 315 is disposed rearwardly of the rear manifold 323 and has its mixing chamber 320 disposed within the annulus of the manifold 323 so that the hot gases flow within the core and heat the tubes 327, exhausting through an opening 329 in the front of a converging portion 331 of the housing 321. The compressed air enters the tube 336 flowing forwardly until it exits within the housing 312 adjacent the wall 313. It thereafter fills the housing 312 and flows into a pair of tubes 333 which communicate with the rear manifold 323. The air thus flows through the tubes 327 exiting into the front manifold 325. A tubular nozzle 337 is connected to the manifold 325 and extends through the opening 329 of the housing 321 to carry and direct the heated air from the manifold 325 onto the surface to be cleaned. As in the other embodiments the burner may include an aperture 338 for receiving air for combustion. A pilot supply tube 341 may carry fuel for a pilot light.

In each of the disclosed embodiments the high pressure air is heated in a heating zone and exhausted through a nozzle onto the surface to be cleaned. It has been found that exceptionally good results are obtained even on wood when carrying out the principles of this invention.

Figure 6:
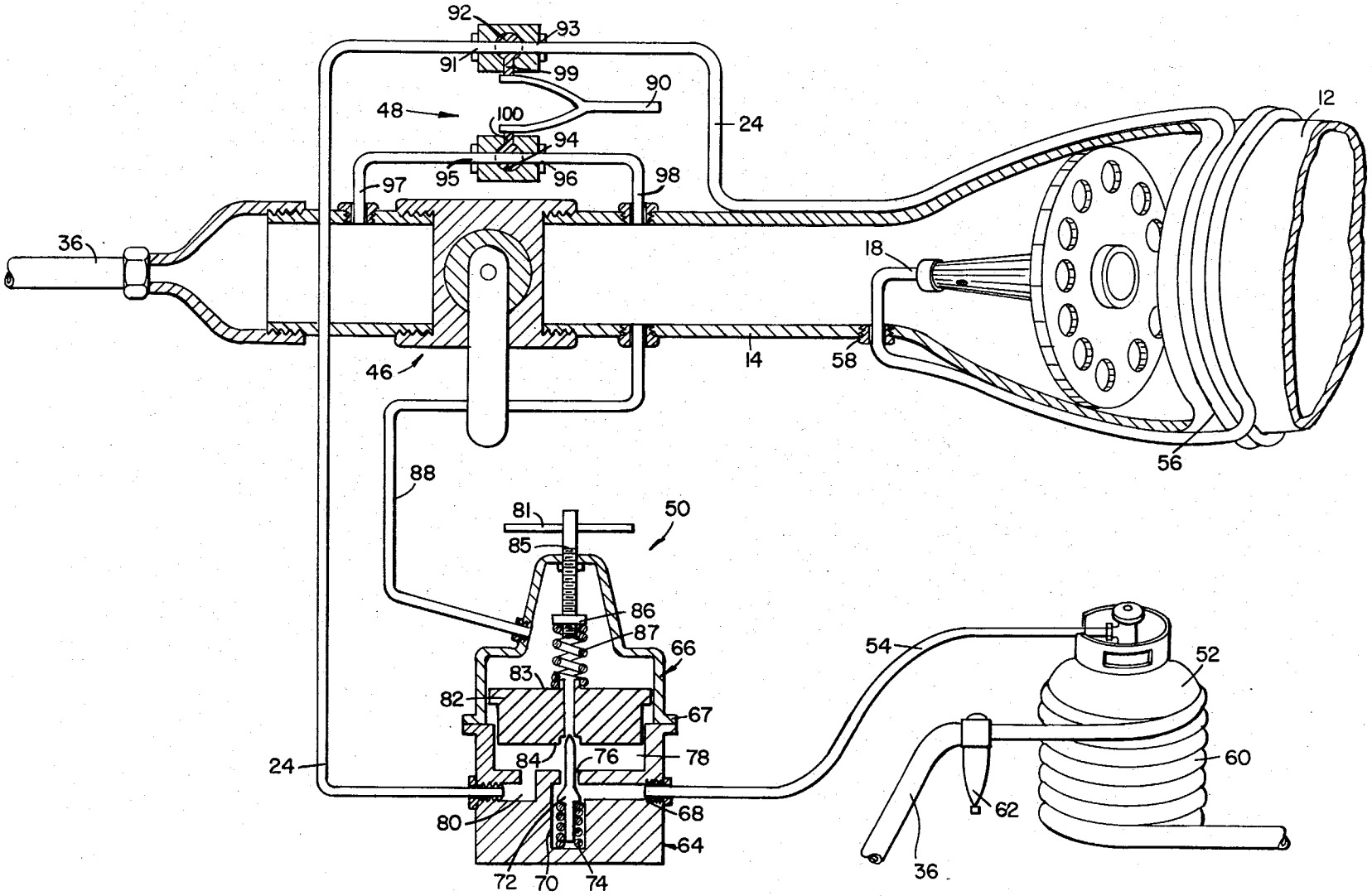
FIG. 6 is a diagrammatic perspective view with parts in cross section of a paint remover constructed in accordance with the embodiment of FIG. 1 including valving and heat exchangers for supplying a gaseous fuel to the paint remover under effective pressure and temperature conditions.

Referring to FIG. 6 the first embodiment of the paint removing device is illustrated having a preferred form of the valving and the air and fuel supply system. Rather than controlling the fuel and air flow by the simple valve 17 and supply lines illustrated in FIG. 1, the preferred system includes a main air valve 46 of conventional form for controlling the volume of compressed air supplied to the device, a start-up/low pressure valve 48 for permitting the burner to ignite and remain lit when the main valve is shut, and a gas pressure regulator 50. The fuel is supplied from a conventional L.P. fuel tank 52 under high pressure through piping 54 to the regulator 50 which controls the pressure as hereinafter described to insure that the pressure of the gaseous fuel is sufficient to enter the high pressure atmosphere of the burner. The fuel flows through valve 48 into the fuel line 24 which preferably is formed into a coil 56 about the paint remover housing 12 for preheating the gas to insure that it remains in a gaseous state at the approximately 100 psi entry pressure. The fuel line 24 enters the rear cylindrical portion 14 of the housing through a bushing 58 and is connected into the mixing section 20.

The compressed air supplied by compressor 34 (FIG. 1) preferably enters a copper coil 60 spiraled about the tank 52 so that some of the heat from the air is transferred to the fuel to heat the fuel and thereby maintain its pressure until the tank is substantially empty. The air exiting the coil 60 is thus at a low temperature and can more easily give up moisture by passing through a conventional moisture trap 62 in the line prior to entry into the paint remover. It is expected that a more effective paint removing medium will be provided by the drier air. The outside of the copper coils 60 may be covered with a substantially water proof shell such as fiber glass and if desirable may enclose a liquid heat transfer medium such as water between the shell and the tank for transferring the heat from the coils to the tank.

The pressure regulator 50 comprises a lower section 64 derived from a conventional pressure regulator and a novel upper section 66, the two sections being connected together at flanges 67. The pressurized gas enters the lower section 64 through an inlet port 68 which opens into a cavity 70 within which a poppet valve 72 is positioned and urged upwardly by a spring 74 seated in the bottom of the cavity. The upper portion of the poppet valve 72 is elongated and extends upwardly through a channel 76 which opens into a hollow 78. The hollow 78 communicates with a passage 80 forming an exhaust port into which the fuel line 24 is connected. The upper section 66 is substantially hollow and includes a piston member 82 which, as illustrated, has a larger cross sectional surface at the top 83 than at the bottom 84. An adjusting member 81 having a stem 85 threaded into the top of the upper section of the regulator effects a force to act against the top surface 83 of the piston through a washer 86 secured to the stem and a spring 87 which abuts the piston. An air feed-back line 88 communicates with the top of the piston 83 and with the cylindrical portion 14 of the paint remover housing 12.

The valve 48 preferably comprises a pair of ball valves mounted in either a common housing or merely interconnected together so that both can be controlled by a single control handle which may be in the form of a lever 90 as depicted in the drawings. The gas line 24 enters through a port 91 in one of the ball valves 92 and when the openings in the ball are aligned with the port the gas flows out an outlet port 93. Similarly the other ball valve 94 has inlet and outlet ports 95 and 96 respectively, the inlet port communicating with the compressed air pipe 36 upstream from the main air valve 46 through a by-pass line 97, while the outlet port 96 communicates with the cylindrical section 14 downstream of the valve 46 through a line 98 entering therein. Both ball valves are in phase so that both are opened and closed together by the lever 90 which may have bifurcated arms attached to cylindrical lugs 99 and 100 on the balls 92 and 94 respectively. Thus, with the main valve 46 closed the air can by-pass the main valve 46 through the valve 48 for start-up and low pressure operation as now to be explained.

The valve 48 functions in a manner similar to a pilot valve in that it allows the burner to remain lit when the main air valve 46 is shut as long as the fuel and air are respectively supplied through lines 24 and 36. When the operator control lever 90 is positioned to align the inlet and outlet ports of the ball valves, air enters the cylindrical section 14 of the paint remover and gas fuel enters the burner mixer 20. Because of the low volume of air, a low pressure condition exists in the burner, ignition can be effected and combustion can be maintained.

At start-up with the main air valve 46 closed and the valve 48 opened, gas fuel enters port 68 of the regulator 50 and flows past the poppet valve piston 72 into the hollow 78. The pressure of the gas forces the piston 82 upwardly against spring 87 tending to allow spring 74 to force the poppet toward closing the passage 76. The handle 81 is adjusted so that sufficient gas can flow through the passage 76 and out the exit port 80 to line 24 to provide sufficient gas under pressure to light the burner. The main valve 46 is thereafter opened for the paint removing operation. As more air under pressure flows through the valve 46 and the pressure in the cylindrical section 14 increases the feed-back line 88 communicates this pressure to the upper surface 83 of the piston 82. This forces the piston 82 downwardly, aiding the spring 87 against the upper portion of the poppet valve 72, to overcome the urging of the spring 74 and to open the passageway 76 further. Thus the gas pressure exiting through the port 80 increases gradually to the pressure of the tank 52 as the flow of compressed air increases through the valve 46. Once the main valve 46 is fully opened and operating pressure is assumed, the operating temperature can be adjusted by adjusting the handle 81. Thus, the regulator 50 overcomes the necessity of gradually manually increasing the gas pressure as the valve 46 is manually opened. The larger surface 83 at the top of the piston 82 relative to the bottom surface 84 ensures that gas pressure to the device 10 is above the air pressure so that the gas freely flows to the burner in the high pressure compressed air atmosphere.

Numerous alterations of the structure herein disclosed will suggest themselves to those skilled in the art. However, it is to be understood that the present disclosure relates to the preferred embodiments of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. The method of removing old paint from a surface comprising, providing a housing having an air heating chamber, a nozzle having a cross-sectional area less than that of the air heating chamber, and a burner including a mixing chamber, feeding pressurized air to the housing, surrounding the burner with the pressurized air while bleeding a small portion of the air into the burner mixing chamber and directing the remaining air into the air heating chamber, mixing the air in the mixing chamber with a fuel to provide a combustible fuel mixture, burning the fuel mixture to form a hot gas, transferring heat from the hot gas to the air in the air heating chamber to heat the air, directing the heated air from the heat chamber into the nozzle for increasing the velocity of the air in the nozzle relatively to the velocity of the air in the air heating chamber and for exhausting the hot air from the nozzle as a high velocity concentrated stream, exhausting the hot gas from the housing, and directing both the hot air stream and the hot gas onto the painted surface to remove the old paint without damaging the surface.

2. In the method as recited in claim 1, wherein said hot gas is mixed with said hot air just prior to entering the nozzle and exhausted through the nozzle therewith.

3. In the method as recited in claim 1, wherein said hot gas is mixed with the air in the heating chamber and the mixture of hot air and hot gas is exhausted through the nozzle.

4. In the method as recited in claim 1, wherein the hot gas is exhausted about the nozzle and is mixed with the hot air as the hot air exhausts from the nozzle.

5. In the method as recited in claim 1, wherein the temperature of the air stream is in the range of approximately 400° to 500° F.

* * * * *